US006354524B1

(12) United States Patent
Nakayama et al.

(10) Patent No.: US 6,354,524 B1
(45) Date of Patent: Mar. 12, 2002

(54) MOBILE CRUSHING MACHINE

(75) Inventors: Tooru Nakayama, Kanagawa; Teruo Nakahara, Tokyo; Kazuhiro Yoshida, Kanagawa; Mitsunobu Yamada, Kanagawa; Motoki Kurohara, Kanagawa; Satoru Koyanagi, Kanagawa; Katsuhiro Ikegami, Kanagawa, all of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/446,002

(22) PCT Filed: Jun. 18, 1998

(86) PCT No.: PCT/JP98/02728

§ 371 Date: Dec. 15, 1999

§ 102(e) Date: Dec. 15, 1999

(87) PCT Pub. No.: WO98/58741

PCT Pub. Date: Dec. 30, 1998

(30) Foreign Application Priority Data

Jun. 20, 1997 (JP) ..... 9-163616

(51) Int. Cl.[7] ..... B02C 25/00

(52) U.S. Cl. ..... 241/34; 241/81; 241/101.74

(58) Field of Search ..... 241/34, 101.74, 241/81

(56) References Cited

FOREIGN PATENT DOCUMENTS

| | | |
|---|---|---|
| JP | 4-210258 | 7/1992 |
| JP | 5-115809 | 5/1993 |
| JP | 6-55095 | 3/1994 |
| JP | 3000546 | 6/1994 |
| JP | 8-299838 | 11/1996 |

*Primary Examiner*—Mark Rosenbaum
(74) *Attorney, Agent, or Firm*—Armstrong, Westerman, Hattori, McLeland & Naughton, LLP

(57) ABSTRACT

A self-propelling crushing machine comprises a machine body (2) provided with a travelling body (1); a hopper (4), a feeder (5), a selective feeder (6) and a crusher (3) which mounted to the machine body; a conveyer (7) disposed below the machine body; and a controlling device for independently controlling the feeder, the selective feeder, the crusher and the conveyer, wherein the feeder conveys a material to be crushed in the hopper to the selective feeder, the selective feeder selects the material to be crushed conveyed by the feeder so as to fall down soil, shingle and the like and convey large rock to the crusher, and the conveyer discharges the selected soil, shingle and the like and material pieces crushed by the crusher.

4 Claims, 8 Drawing Sheets

MOBILE CRUSHING MACHINE

TECHNICAL FIELD

The present invention relates to a self-propelling crushing machine for crushing concrete wodge, rock or the like.

BACKGROUND TECHNOLOGY

Japanese patent Laid-open (KOKAI) publication No. HEI 5-115809 discloses one example of a known self-propelling (crawler-type) crushing machine having a vehicle body provided with a travelling body, and a hopper, a vibrating feeder provided with a grizzly, crusher, conveyer and others.

According to such crushing machine, materials thrown into the hopper are selected by the vibration feeder provided with the grizzly, so that the materials having small sizes are fallen down on the conveyer and the materials having large size are fed to the crusher, and the material pieces crushed by the crusher are fallen down on the conveyer, thus conveying the materials.

It is required as a matter of importance for the self-propelling crushing machine to make short the longitudinal length thereof because it must run or work in a narrow working area, and to achieve such requirement, the hopper is arranged above the vibrating feeder provided with the grizzly.

According to the arrangement of the vibrating feeder provided with the grizzly above the hopper, the vibration feeder has a structure having a flat plate receiving the material to be crushed thrown into the hopper, a grizzly bar continuously connected to the flat plate and vibration exciters for vibrating these flat plate and the grizzly bar. The material to be crushed thrown into the hopper is conveyed to the grizzly bar by the vibration of the flat plate, and thereafter, the material to be crushed is then selected and conveyed to the crusher by the vibration of the grizzly bar.

The vibration exciters for vibrating the flat plate and the grizzly bar include, respectively, a pair of rotational shafts on which eccentric rolls are mounted, and vibration in one direction (unidirectional vibration) is generated by the pressing function of the eccentric rolls. As the direction of the vibration approaches a horizontal direction, the conveying ability of the flat plate is made large and the material selecting ability of the grizzly bar is made small, and on the contrary, as the direction of the vibration approaches a vertical direction, the conveying ability of the flat plate is made small and the material selecting ability of the grizzly bar is made large.

Then, in order to improve the crushing efficiency and treating ability of the crusher, it will be better to charge large materials to be crushed into the hopper by an amount suitable for the maximum treating ability of the crusher.

In consideration of the above matters, in the conventional self-propelling crushing machine, the crushing efficiency and the treating ability have been improved by setting the conveying ability of the flat plate of the vibrating feeder having the grizzly to the maximum treating ability of the crusher.

By the way, although usual materials to be crushed can be crushed by the self-propelling crushing machine with the improved crushing efficiency and treating ability in the manner described above, in a case where rock mixed with a large amount of mixed soil, shingles and the like is to be crushed, the selecting ability of the grizzly bar is made small. For this reason, a portion of the soil, shingle and the like is charged to the crusher without sufficiently selecting the soil, shingle and the like, and in addition, a large amount of materials to be crushed stayed on the grizzly bar, which is then fallen down on the crusher and an amount charged to the crusher becomes large (that is, creating overcharge state).

Furthermore, in the case where the soil, shingle and the like are fed to the crusher and create the overcharge state, the treating ability of the crusher is extremely lowered and, moreover, the life time of a crusher tooth will be made short.

Further, when the selecting ability of the grizzly bar is made large to sufficiently select the soil, shingle and the like thereby to prevent them from being charged to the crusher in order to obviate such defect, the conveying ability of the flat plate is contrarily made small as mentioned above, and hence, an amount of the material to be crushed is reduced and the treating ability of the crusher is also reduced.

Then, an object of the present invention is to provide a self-propelling crushing machine capable of solving the problems mentioned above.

DISCLOSURE OF THE INVENTION

One embodiment according to the present invention provides a self-propelling crushing machine comprising:

a machine body provided with a travelling body;

a hopper, a feeder, a selective feeder and a crusher which are mounted to the machine body;

a conveyer disposed below the machine body; and a controlling device for independently controlling the feeder, the selective feeder, the crusher and the conveyer, wherein the feeder conveys a material to be crushed in the hopper to the selective feeder, the selective feeder selects the material to be crushed conveyed by the feeder so as to fall down soil, shingle and the like and convey large rock to the crusher, and the conveyer discharges the selected soil, shingle and the like and material pieces crushed by the crusher.

According to this structure, the material to be crushed in the hopper is conveyed by the feeder to the selective feeder, by which the soil, shingle and the like are selected from the large rocks or the like and the rocks are then charged to the crusher and crushed therein. The crushed pieces and the soil and shingles are discharged by the conveyer.

Therefore, the material including the soil and shingle to be crushed can be crushed with an improved crushing efficiency and an improved treating ability and the material pieces crushed can be discharged together with the soil and shingle and the like.

Furthermore, since the conveying ability of the feeder and the conveying ability and selecting ability of the selective feeder can be independently set, it is possible to make large the selecting ability of the selective feeder and make equal the conveying abilities of the feeder and the selective feeder to each other.

Accordingly, the selecting ability of the selective feeder can be set in accordance with the amount of the soil and the shingle mixed in the material to be crushed, and in addition, the conveying abilities of the feeder and the selective feeder can be set to values corresponding to the maximum treating ability of the crusher.

Therefore, the material containing much amount of the soil and single can be crushed without lowering the crushing efficiency and the treating ability, and moreover, the lifetime of the crusher tooth cannot be made short.

In the above one embodiment, it is preferred that:

the feeder is provided with a flat plate and vibrated in an obliquely upper direction with respect to a horizontal plane by a first vibration exciter, the selective feeder is provided with a grizzly bar and vibrated in an obliquely upper direction with respect to a horizontal plane by a second vibration exciter, and the vibrating direction of the first vibration exciter is made near the horizontal plane more than the vibrating direction of the second vibration exciter, the second vibration exciter vibrates in a magnitude more than that of the first vibration exciter thereby to make large a selecting ability of the selective feeder and to make a conveying ability of the feeder substantially equal to that of the selective feeder.

According to this structure, the feeder and the selective feeder can be composed of simple structures or shapes using the first and second vibration exciters, and the conveying abilities thereof can be made equal while increasing the selecting ability of the selective feeder.

Therefore, the material to be crushed including much amount of soil, shingle and the like can be crushed with a sufficient selecting ability of the soil and the shingle to improve the crushing efficiency and the treating ability.

Furthermore, in the above one embodiment, it is preferred that the self-propelling crushing machine further comprises:

a crusher overload detection means for detecting an overload state of the crusher;

means for making variable the conveying ability of the feeder; and a controlling means for lowering the conveying ability of the feeder at a time when the crusher is discriminated to be in an overload state.

According to this structure, at a time when the crusher is in an overload state, the conveying ability of the feeder is lowered and the amount of the material to be conveyed to the selective feeder is reduced. On the other hand, the selecting ability of the selective feeder is not lowered.

Therefore, a small amount of only the large rock can be charged to the crusher while sufficiently selecting the soil and the shingle.

Thus, the load of the crusher can be reduced to a normal load state without charging the soil, shingle and the like mixed in the material to be crushed.

Furthermore, in the above one embodiment, it is preferred that the self-propelling crushing machine further comprises:

a selective feeder overload detection means for detecting an overload state of the selective feeder;

means for making variable the conveying ability of the feeder; and a controlling means for lowering the conveying ability of the feeder at a time when the selective feeder is discriminated to be in an overload state.

According to this structure, at a time when the selective feeder is in an overload state, the conveying ability of the feeder is lowered and the amount of the material to be conveyed to the selective feeder is reduced. On the other hand, the selecting ability of the selective feeder is not lowered.

Therefore, the material to be crushed conveyed to the selective feeder can be sufficiently selected and the selective feeder is made in a normal load state.

In this structure, the selective feeder overload detection means is composed of means for detecting a fact that a material to be crushed is stayed on the grizzly bar in a level more than a predetermined height level.

According to this structure, at a time when the material to be crushed is stayed on the grizzly bar of the selective feeder at a level more than a predetermined height level, the conveying ability of the feeder is lowered and the conveying amount to the selective feeder is lowered, while the selecting ability of the selective feeder is not reduced.

Accordingly, even at a time when the material to be crushed includes soil having high viscosity, which is difficult to be sufficiently selected by the selective feeder, the material can be sufficiently selected by the selective feeder and only the large rocks are charged to the crusher.

Thus, the material to be crushed including soil having high viscosity can be crushed without lowering the crushing efficiency and the treating ability.

Furthermore, in the above one embodiment, it is preferred that the self-propelling crushing machine further comprises:

a crusher overcharge detection means for detecting an overcharge state of the crusher;

means for making variable the conveying ability of the feeder; and a controlling means for lowering the conveying ability of the feeder at a time when the crusher is discriminated to be in an overcharge state.

According to this structure, at a time when the crusher is made in an overcharge state of the material to be crushed, the conveying ability of the feeder is lowered and the amount of the material to be conveyed to the selective feeder is reduced, while the selecting ability of the selective feeder is not lowered.

Accordingly, a small amount of only the large rock is charged to the crusher while sufficiently selecting the soil, shingle and the like by the selective feeder, and hence, the charging amount to the crusher is reduced and made in a normal charging state.

Furthermore, in the above one embodiment, it is preferred that the self-propelling crushing machine further comprises:

a conveyer overload detection means for detecting an overload state of the conveyer;

means for making variable the conveying ability of the feeder; and a controlling means for lowering the conveying ability of the feeder at a time when the conveyer is discriminated to be in an overload state.

According to this structure, at a time when the conveyer is in the overload state, the conveying ability of the feeder is lowered and the amount of the material to be conveyed to the selective feeder is reduced.

Accordingly, an amount of the soil and shingle to be selected by the selective feeder is reduced and the amount to be charged to the crusher can be also reduced.

Thus, the amount of the material to be charged to the conveyer is reduced and the normal load state can be realized.

BRIEF DESCRIPTION OF THE DRAWINGS

The present invention will be made more understandable by way of the following detailed description and accompanying drawings showing exemplary embodiments of the present invention. Further, the embodiments shown in the accompanying drawings do not specify the invention and are for the explanation of the invention and easy understanding thereof.

In the accompanying drawings.

PREFERRED MODE FOR EMBODYING THE INVENTION

A self-propelling crushing machine of a preferred embodiment of the present invention will be described hereunder with reference to the accompanying drawings.

Figure 1:
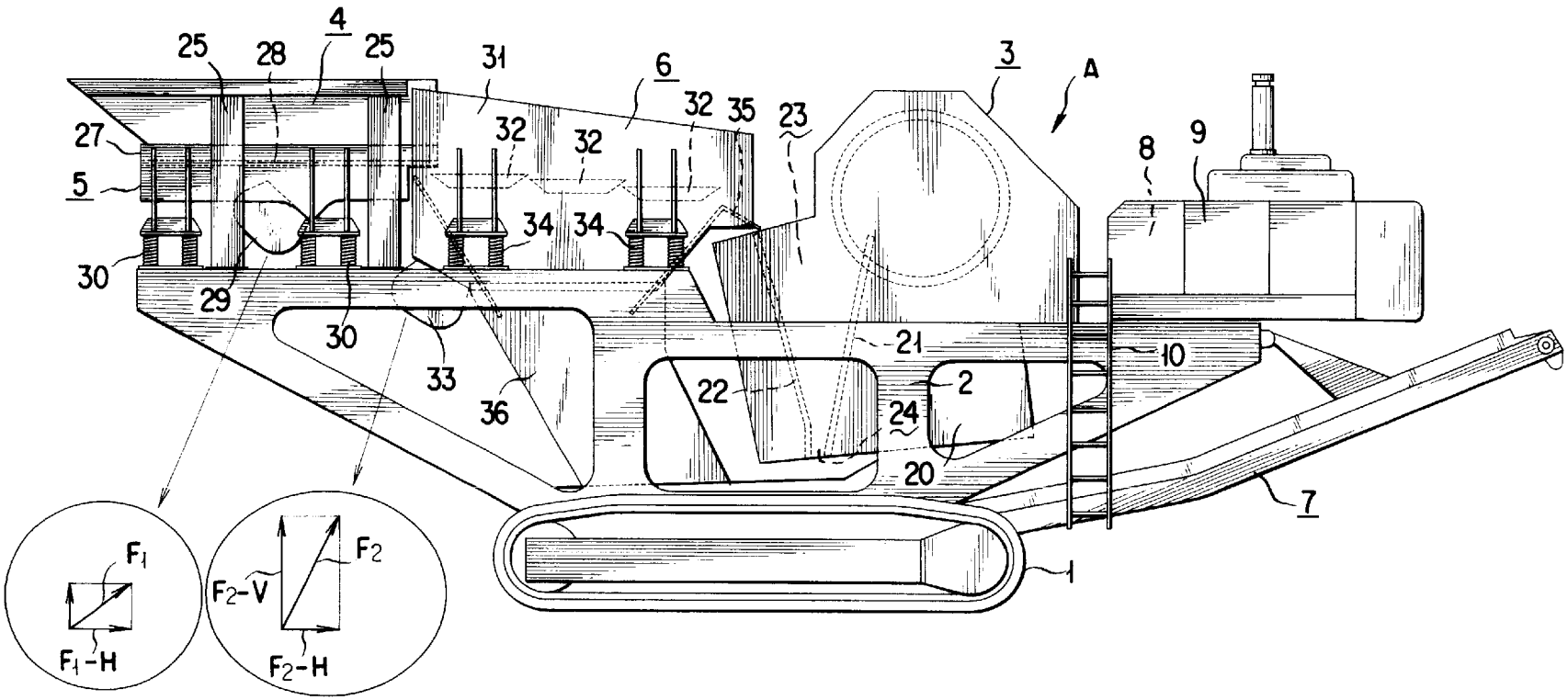
FIG. 1 is a front view of a self-propelling crushing machine according to one embodiment of the present invention.
Figure 2:
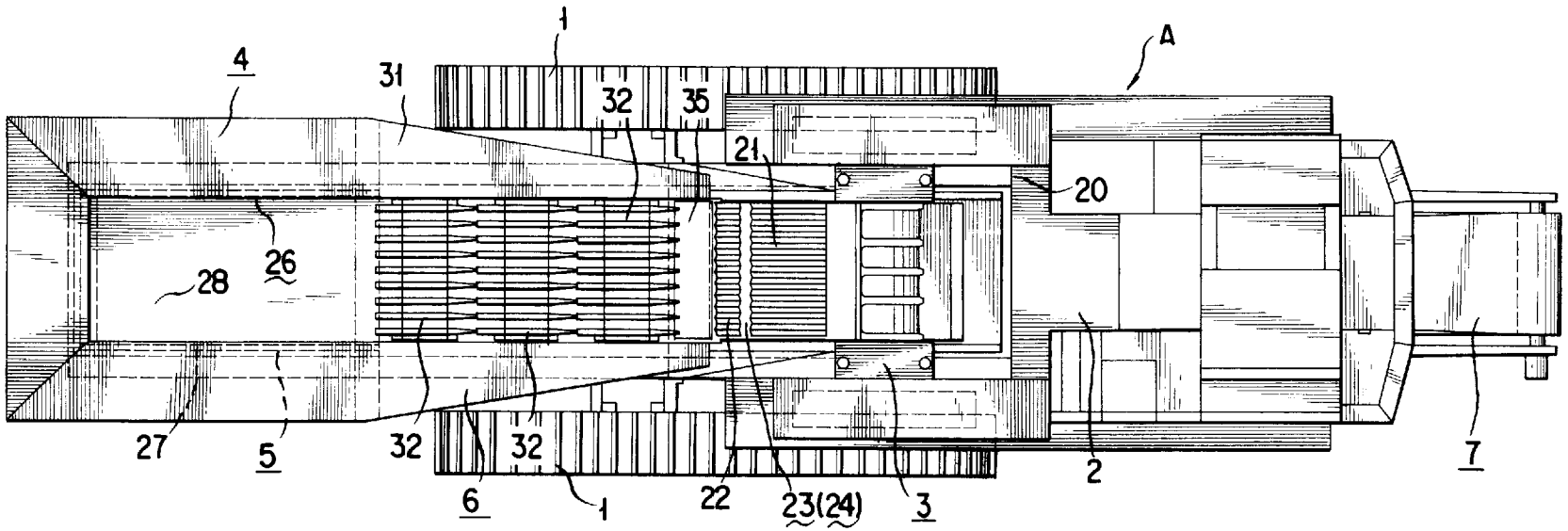
FIG. 2 is a plan view of the above one embodiment.

As shown in FIGS. 1 and 2, in a self-propelling crushing machine A, a hopper 4, a feeder 5, a selection feeder 6, a crusher 3 and a conveyer 7 are provided for a machine body 2 equipped with a travelling body 1 so as to be arranged in order in a longitudinal direction (travelling direction) of the machine body 2. A power source 8 such as engine is mounted to a rearward portion of the crusher 3 of the machine body 2, and the power source 8 is covered by a cover 9. A ladder 10 is provided for the machine body 2 for the easy access of a person at an inspection time of the power source 8, the crusher 3 and the like.

The crusher 3 is arranged to an intermediate portion of the machine body 2 in the longitudinal direction (travelling direction) thereof. The crusher 3 is of a jaw-type crusher having a body 20 in substantially a square shape in plane in which a movable tooth 21 and a stationary tooth 22 are mounted to the body 20 so as to provide a V-shape in a vertical section in a manner that a charge port 23 and a discharge port 24 are formed to upper and lower portions of the machine body 2, respectively. The movable tooth 21 has a pivotal lower end and an upper end connected to an eccentric rotation shaft, and when the movable tooth 21 is swung towards the stationary tooth 22 by means of the eccentric rotation shaft, the material fed through the charge port 23 is crushed and the crushed pieces are discharged through the discharge port 24 and then fallen down on the conveyer 7.

The hopper 4 is mounted to the machine body 2 by means of a support column 25 at a portion on the front end side of the machine body 2. The hopper 4 is provided with a bottom discharge port 26 below which the feeder 5 is arranged. The feeder 5 is composed of a frame structure 27 to which a flat plate 28 is attached, and a vibration exciter 29 is mounted to this frame structure 27, which is mounted to the machine body 2, through an elastic member 30, at a portion on the front end side thereof. The flat plate 28 is positioned below the bottom discharge port 26 of the hopper 4.

The selective feeder 6 comprises a frame structure 31, three grizzly bars 32, arranged in a line in the material conveying direction, and a vibration exciter 33, the grizzly bars 32 and the vibration exciter 33 being attached to the frame structure 31, and the frame structure 31 is attached to a forward portion of the machine body 2 through an elastic member 34. The grizzly bars include a convey-in side grizzly bar 32 having a convey-in side end to which the flat plate of the feeder 5 is overlapped and also includes a convey-out side grizzly bar 32 having a convey-out side end which is overlapped to an oblique charging plate 35.

The materials to be selected such as soil, shingle and the like fallen down through a space between the grizzly bars 32 are then fallen down on the conveyer 7 through a chute 36.

The vibration exciter 29 of the feeder 5 is adapted to apply a vibration force $F_1$ in substantially 45° direction to the frame structure 27, and the conveying ability is made large by making large a horizontal component $F_1$-H of the vibration force $F_1$. The vibration exciter 33 of the selective feeder 6 is adapted to apply a vibration force $F_2$ in a direction of more than 45°, for example 60°, to the frame structure 31, and the selecting ability is made large by making large a vertical component $F_2$-V of the vibration force $F_2$. Further, the vibration force $F_2$ of the vibration exciter 33 is larger than the vibration force $F_1$ of the vibration exciter 29, and a horizontal component $F_2$-H of the vibration force $F_2$ is substantially the same as the horizontal component $F_1$-H of the vibration force $F_1$ of the vibration exciter 29.

According to the structure mentioned above, the material to be crushed in the hopper 4 is conveyed to the selective feeder 6 by means of feeder 5, the soil, shingle and the like selected by the selective feeder 6 are fallen down on the conveyer 7 through the chute 36, and other materials such as large rock not selected are charged into the charge port 23 of the crusher 3 by the charging plate 35. The large materials such as rock charged to the crusher 3 are then crushed, and the crushed pieces are fallen down on the conveyer 7 thereby to be discharged outward.

Further, the selective feeder 6 has the conveying ability substantially the same as that of the feeder 5 as well as the large selecting ability, so that the selective feeder 6 can adequately select a large amount of soil, shingle and the like mixed in the material to be crushed and can also convey large rocks or the like to the crusher 3 at the same conveying speed as that of the feeder 5.

A control system according to the above embodiment will be described hereunder.

Figure 3:
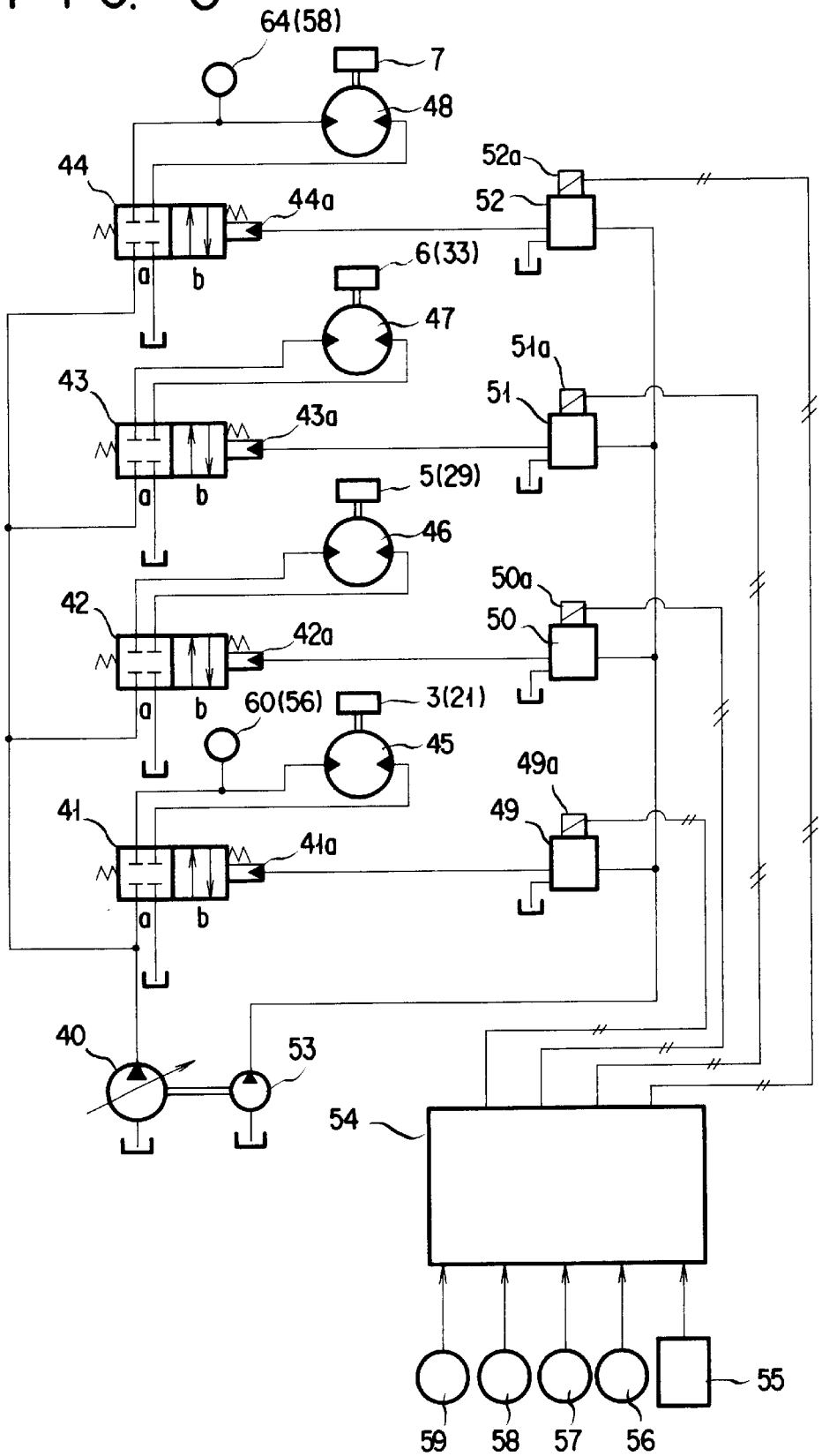
FIG. 3 shows an operation control circuit diagram of the above one embodiment.

With reference to FIG. 3, a drain (discharge) pressurized oil from a hydraulic pump 40 are distributed and supplied to a hydraulic motor 45 for the crusher, a hydraulic motor 46 for the feeder, a hydraulic motor 47 for the selective feeder and a hydraulic motor 48 for the conveyer by way of a directional control valve 41 for the crusher, a directional control valve 42 for the feeder, a directional control valve 43 for the selective feeder and a directional control valve 44 for the conveyer, respectively.

The hydraulic motor 45 for the crusher operates to swing the movable tooth 21 of the crusher 3. The hydraulic motor 46 for the feeder operates to rotate a pair of rotation shafts of the vibration exciter 29 of the feeder 5. The hydraulic motor 47 for the selective feeder operates to rotate a pair of rotation shafts of the vibration exciter 33 of the selective feeder 6. The hydraulic motor 48 for the conveyer operates to rotate a driving pulley of the conveyer 7.

The respective directional control valves 41, 42, 43 and 44 mentioned above are held at their neutral positions a by means of springs and are pushed towards oil supply positions b by pressures in proportion to the pressures of the pressurized oils supplied to pressure receiving portions 41*a*, 42*a*, 43*a* and 44*a* of the respective directional control valves 41, 42, 43 and 44, to which the discharge pressurized oil from the hydraulic pump 53 are supplied by means of first, second, third and fourth electromagnetic proportional pressure control valves 49, 50, 51 and 52, respectively.

The first, second, third and fourth electro-magnetic proportional pressure control valves 49, 50, 51 and 52 include solenoids 49*a*, 50*a*, 51*a* and 52*a*, respectively, and operate to output pressures in proportion to conduction current values to the respective solenoids 49*a*, 50*a*, 51*a* and 52*a*. The conduction current values to the respective solenoids 49*a*, 50*a*, 51*a* and 52*a* are controlled by a controller 54.

An operation start/stop signal is inputted to the controller 54 through an operation panel 55. A crusher overload signal is inputted to the controller 54 through a crusher overload detection means 56. A selective feeder overload signal is inputted to the controller 54 through a selection feeder overload detection means 57. A conveyer overload signal is inputted to the controller 54 through a conveyer overload detection means 58. A crusher overcharge signal is inputted to the controller 54 through a crusher overcharge detection means 59.

The operation of the above embodiment will be described hereunder.

When the operation start signal from the operation panel 55 is inputted to the controller 54, the controller 54 imparts predetermined currents to the respective solenoids 49*a*, 50*a*, 51*a* and 52*a*. According to such current conduction, the electromagnetic proportional pressure control valves 49, 50, 51 and 52 respectively output predetermined pressures, so that the respective directional control valves 41, 42, 43 and 44 take their supply positions b thereby to drive the respective hydraulic motors 45, 46, 47 and 48 at predetermined rates (speeds).

According to these operations, since the crusher 3, the feeder 5, the selective feeder 6 and the conveyer 7 are driven in preset normal (steady) states, the crushed and selected pieces of the material thrown into the hopper and crushed by the crusher 3 can be discharged by the conveyer 7.

Further, when the operation stop signal from the operation panel 55 is inputted into the controller 54, the controller 54 operates to stop the current conduction to the respective solenoids 49*a*, 50*a*, 51*a* and 52*a*. Then, since the respective electromagnetic proportional pressure control valves 49, 50, 51 and 52 do not output a pressure, and accordingly, the respective directional control valves 41, 42, 43 and 44 take their neutral positions a and the operation of the respective hydraulic motors 45, 46, 47 and 48 stops.

According to these operations, the crusher 3, the feeder 5, the selective feeder 6 and the conveyer 7 are stopped.

Furthermore, when the crusher overload signal is inputted, in the normal driving state mentioned before, from the crusher overload detection means 56 to the controller 54, the controller 54 operates to make zero ("0") or reduce the current conduction to the solenoid 50*a* and then to make zero ("0") or reduce the output pressure to the second electromagnetic proportional pressure control valve 50. Then, the directional control valve 42 for the feeder takes its neutral position a or approaches near the neutral position and the hydraulic motor 46 for the feeder is stopped or operated at a low-speed (reduced-speed).

Accordingly, the rotation shafts of the vibration exciter 29 of the feeder 5 are stopped or operated at a low-speed, and hence, the conveying ability of the feeder 5 is made zero ("0") or made small. Thus, the material conveying ability to the selective feeder 6 is made zero ("0") or reduced, so that the material projection amount to the crusher 3 is made zero ("0") or reduced and the crusher 3 is made in the usual (normal) loaded state.

At this time, since the vibration exciter 33 of the selective feeder 6 is driven at the set value, the selecting ability is not lowered and the soil, shingle and the like can be surely selected and only the large rock is charged to the crusher 3 without charging the soil and the shingle to the crusher 3.

Furthermore, when the conveyer overload signal is inputted into the controller 54 from the conveyer overload detection means 58, the controller 54 makes zero ("0") or reduces the conveying ability of the feeder 5 in the manner mentioned above.

Accordingly, the material to be conveyed to the selective feeder 6 is made ("0") or reduced, and hence, the amount of the material to be fed to the crusher is also reduced, so that the amount of the crushed pieces of the soil, shingle and the like is reduced, whereby the conveyer 7 is made to a normal load state.

Further, when the overcharge signal is inputted to the controller 54 from the crusher overcharge detection means 59 in the normal driving state mentioned above, the controller 54 makes zero ("0") or reduces the conveying ability of the feeder 5 in the manner mentioned above.

Accordingly, since the material to be charged to the crusher 3 is made ("0") or reduced, the crusher 3 takes its normal charge state.

Furthermore, in the normal driving state mentioned above, when the selective feeder overload signal is inputted into the controller 54 from the selective feeder overload detection means 57, in a case where the material to be crushed including a large amount of soils having large viscosity, for example, is conveyed to the selective feeder 6 and the soil is hence not adequately selected even by giving a large vertical vibration (i.e. large selecting ability), the controller 54 operates to make Zero ("0") or reduce the conveying ability of the feeder 5 as mentioned above thereby to reduce the conveying amount to the selective feeder 6 so as to make the selective feeder 6 to the normal load state.

The crusher overload detection means 57 is, as shown in FIG. 3, composed of a pressure sensor 60 detecting a feed pressure to the crusher hydraulic motor 45, and when the detected pressure of the pressure sensor 60 is more than a preset pressure, the overload state is discriminated.

Figure 4:
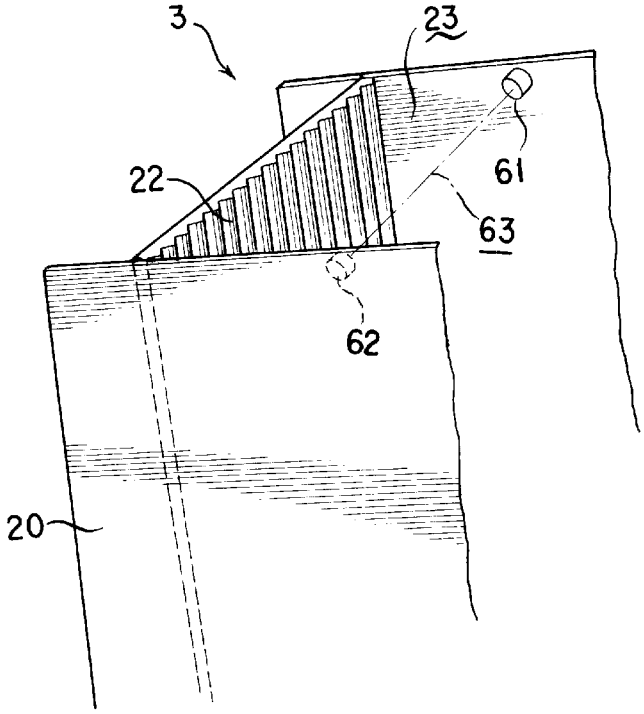
FIG. 4 is a perspective view showing one example of a crusher overcharge detection means of the above one embodiment.

The crusher overcharge detection means 59 is, as shown in FIG. 4, composed of a. light sensor 63 in which a light emitter 61 and a light receiver 62 are disposed in an opposed manner near the charge port 23 of the body 20 of the crusher 3. In this arrangement, when the material to be crushed is fed to the height level of the light emitter 61 and the light receiver 62 and the light receiver 62 does not hence receive the light for a time more than the predetermined time, the overcharge state is discriminated.

The conveyer overload detection means 58 is, as shown in FIG. 3, composed of a pressure sensor 64 detecting a driving hydraulic pressure of the conveyer hydraulic motor 48, and when the detected pressure of the pressure sensor 64 is more than a preset pressure, the overload state is discriminated.

Figure 5:
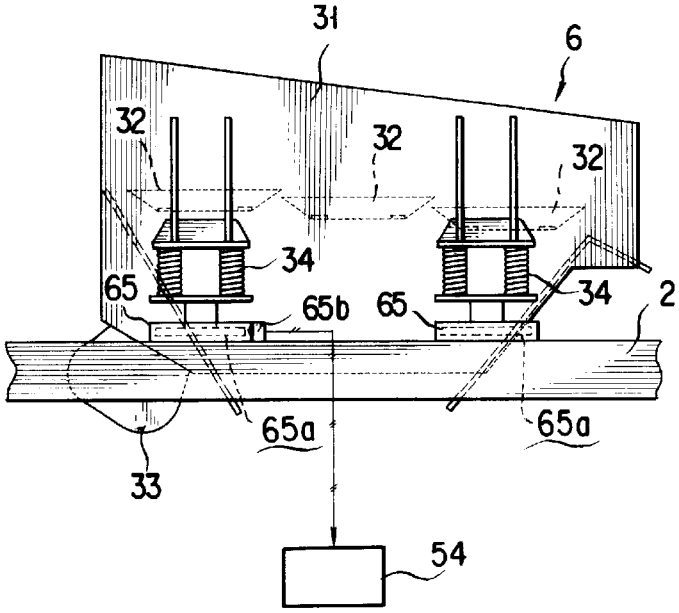
FIG. 5 is a perspective view showing a first example of a selective feeder overload detection means of the above one embodiment.

As the selective feeder overload detection means 57, various devices or equipments will be adopted, and for example, as shown in FIG. 5, there will be taken an arrangement in which the selective feeder 6 is mounted to the machine body 2 through a cylinder 65, an inner pressure in an inside portion 65*a* of the cylinder 65 is detected by a pressure sensor 65*b*, and the overload state of the selective feeder 6 is detected in accordance with the magnitude of the detected pressure.

Figure 6:
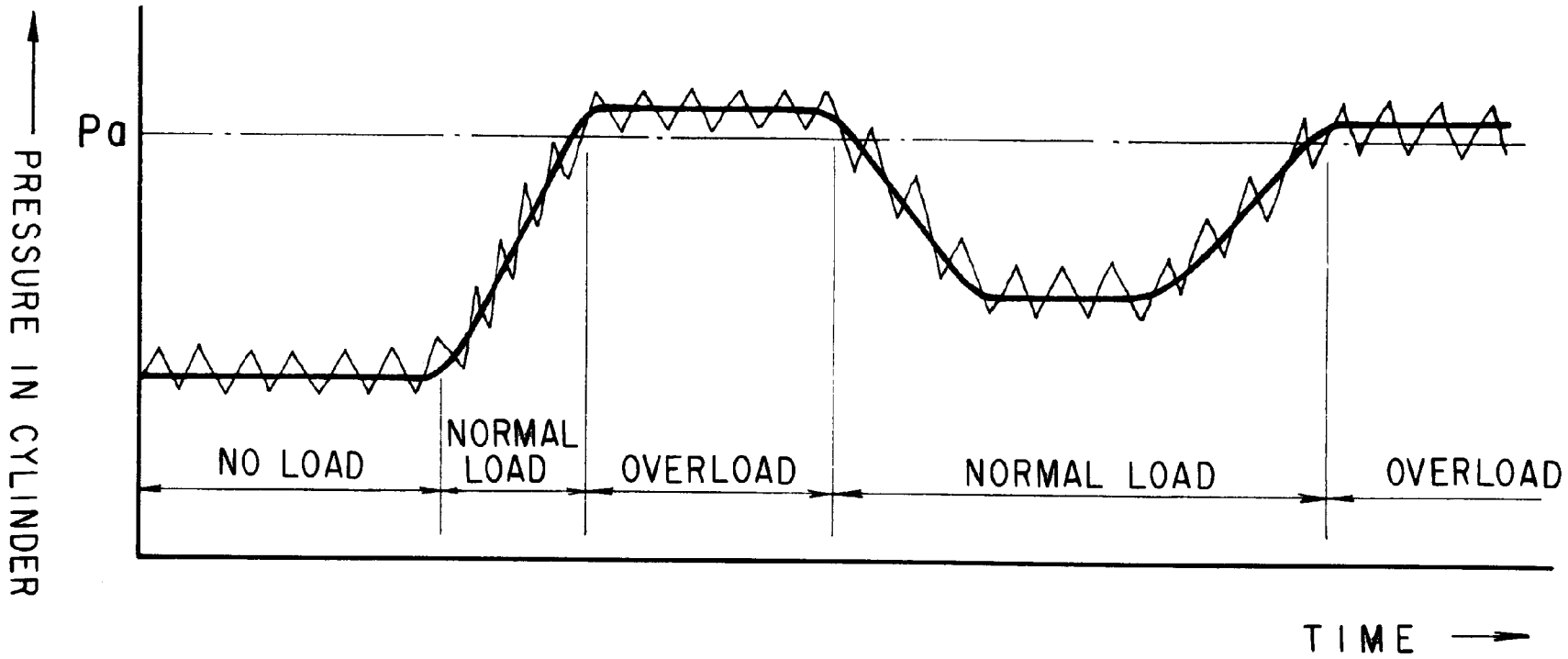
FIG. 6 is a chart showing variation of a pressure in a cylinder according to the above one embodiment.

More concretely, the pressure in the inside portion 65*a* of the cylinder 65 varies by the weight of the material to be conveyed on the grizzly bar 32 as shown with a thick line in FIG. 6 at an operation stop time of the shaker 33, and when the vibration exciter 33 is driven, the pressure varies as shown with a fine line in FIG. 6 along the thick line. Then, at a time when this inner pressure is more than a predetermined pressure Pa, the weight of the material to be conveyed on the grizzly bar 32 is judged to be large, thereby being discriminated as the overload state.

Further, a load cell may be mounted in place of the cylinder 65 mentioned above. In the arrangement of the load cell, a load cell displacement signal varies as like as the cylinder inner pressure shown in FIG. 6 in accordance with the weight of the material to be conveyed on the grizzly bar 32, so that when the displacement signal represents a predetermined value, the overload state will be discriminated.

Figure 7:
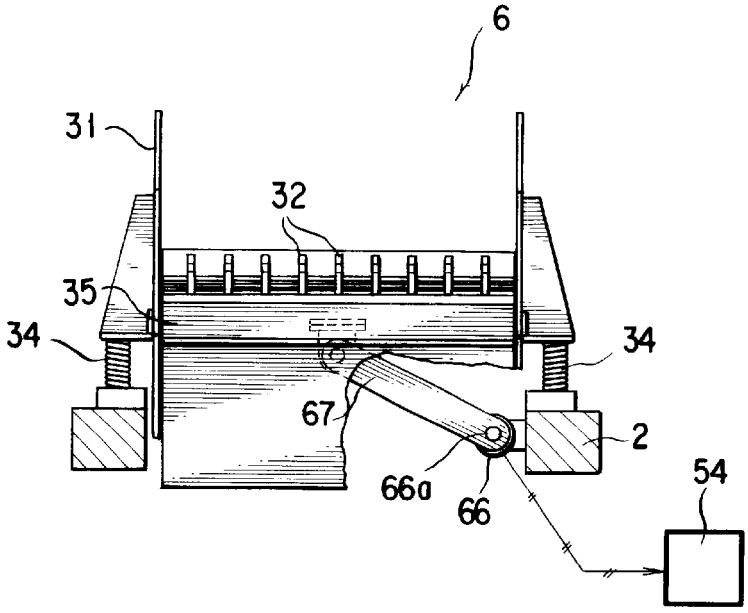
FIG. 7 is a side view showing a second example of a selective feeder overload detection means.

Further, in a modified example shown in FIG. 7, a potentiometer 66 is mounted to the machine body 2 and the potentiometer 66 has a rotational portion 66*a* to which a lever 67 is attached, the lever 67 being connected to the frame structure 31 of the selective feeder 6. An output from the potentiometer 66 is transmitted to the controller 54 thereby to discriminate the overload state at a time of the output being over a predetermined output value.

Figure 8:
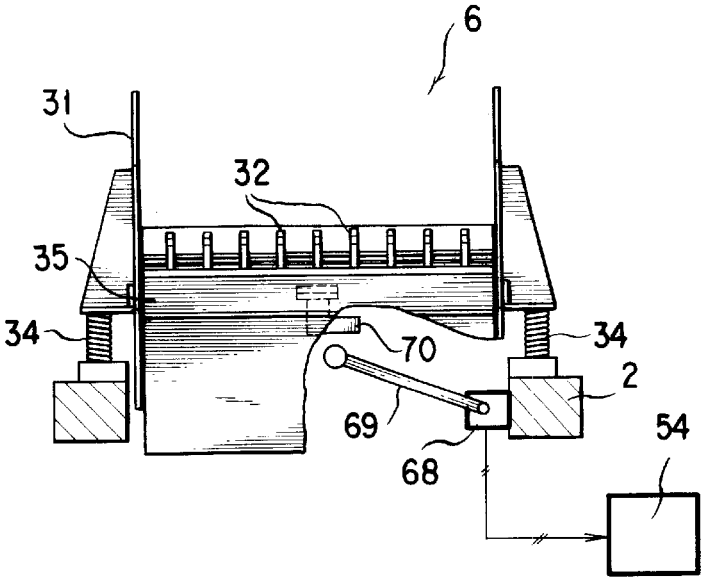
FIG. 8 is a side view showing a third example of a selective feeder overload detection means.

In a further modified example shown in FIG. 8, a limit switch 68 is attached to the machine body 2 in a manner such that a movable piece 69 of the limit switch 68 is opposed to a dog 70 of the frame structure 31 of the selective feeder 6. The limit switch 68 is set to be made "ON" at a time when the frame structure 31 moves downward by a predetermined distance thereby to discriminate the overload state by the "ON" signal from the limit switch 68.

Figure 9:
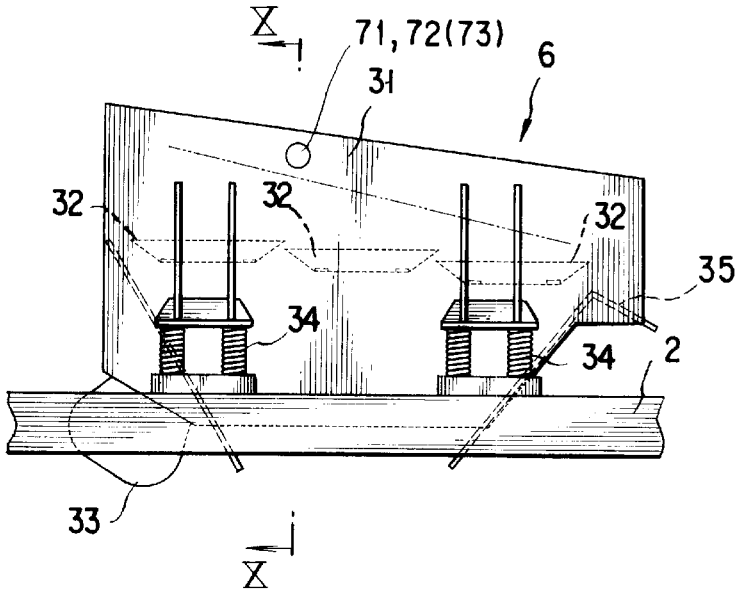
FIG. 9 is a front view showing a fourth example of a selective feeder overload detection means.
Figure 10:
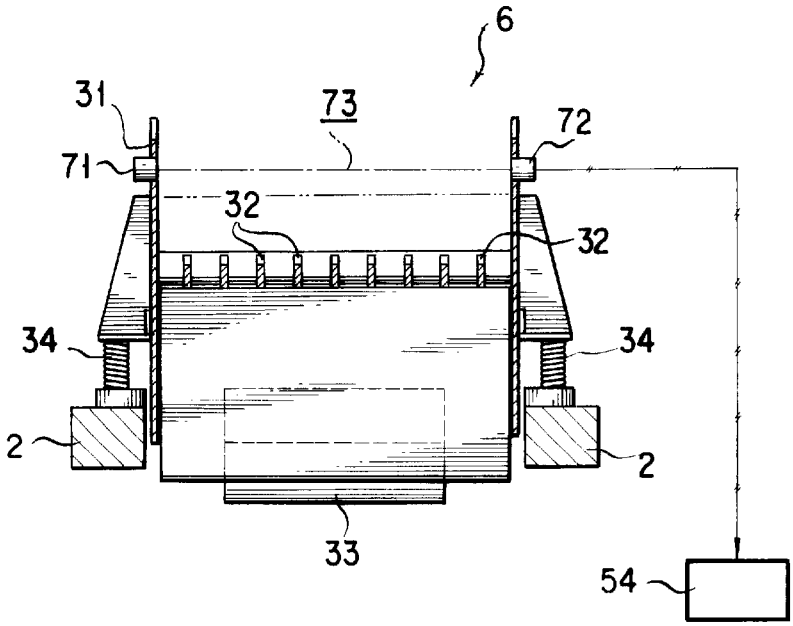
FIG. 10 is a sectional view taken along the line X—X in FIG. 9.

In a further modified example shown in FIGS. 9 and 10, a light sensor 73 is composed of a light emitter 71 and a light receiver 72, which are mounted to bilateral sides of the frame structure 31, respectively. The light sensor 73 is operated such that at a time when the material to be crushed is stayed on the grizzly bar to a level more than a predetermined height level, the light receiver 72 does not receive the light thereby to discriminate the overload state.

Figure 11:
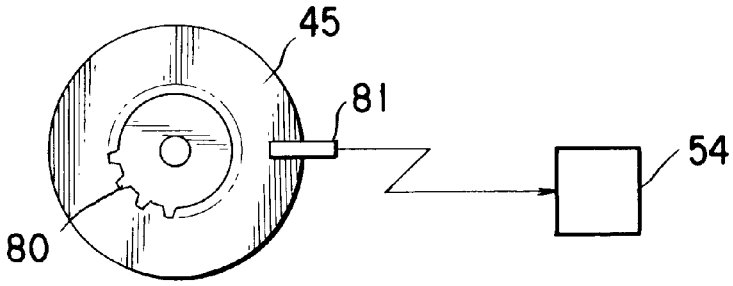
FIG. 11 is a view explaining another example of the crusher overload detection means.

The crusher overload detection means 56 mentioned before may be constructed as follows. As shown in FIG. 11, a rotation detection plate 80 is attached to the crusher hydraulic motor 45 and the revolution number of the crusher hydraulic motor 45 is detected by a rotation sensor 81 disposed so as to oppose to the rotation detection plate 80. In this detection, at a time when the revolution number detected by the rotation sensor 81 is less than the set revolution number, the overload state is discriminated.

Figure 12:
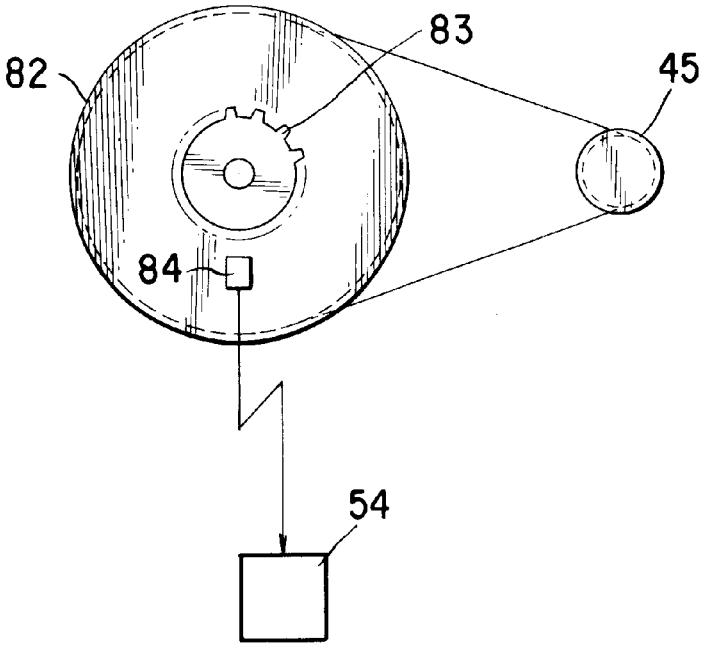
FIG. 12 is a front view showing a further example of the crusher overload detection means.

Further, the crusher overload detection means 56 may be further constructed as follows. As shown in FIG. 12, a rotation detection plate 83 is attached to a crusher flywheel 82 which is secured to a crank shaft and rotated by the crusher hydraulic motor 45 so as to swing the movable tooth 21 through the crank shaft. The rotation number of the crusher flywheel 82 is detected by a rotation sensor 84 disposed to be opposed to the rotation detection plate 83, and at a time when the rotation number detected by the rotation sensor 84 is less than a set rotation number, the overload state is discriminated.

The feeder 5 mentioned hereinbefore is not limited to a device which vibrates the flat plate 28 by the vibration exciter 29, and for example, there may be adopted a plate feeder in which a plate is made reciprocal, a conveyer-type feeder in which a material is conveyed by a conveyer and an apron-type feeder in which a number of receiving portions are provided to a driven endless belt member.

Further, it is self-evident to a person skilled in the art that although the present invention is described hereinbefore with reference to the exemplary embodiments, it is possible to make various changes, deletions and additions to the disclosed embodiment without departing from the subject and scope of the present invention. Accordingly, it is to be understood that the present invention is not limited to the described embodiments and includes scopes or its equivalent scope defined by the elements recited in the appended claims.

What is claimed is:

1. A self-propelling crushing machine comprising:

a machine body (2) provided with a traveling body (1);

a hopper (4), a feeder (5), a selective feeder (6) and a crusher (3) which are mounted to the machine body;

a conveyer (7) disposed below the machine body; and a controlling device for independently controlling said feeder, said selective feeder, said crusher and said conveyer, said feeder having a flat plate (28) and being vibrated in an obliquely upper direction with respect to a horizontal plane by a first vibration exciter and adapted to convey a material to be crushed from the hopper to the selective feeder, said selective feeder having a grizzly bar (32) and being vibrated in an obliquely upper direction with respect to a horizontal plane by a second vibration exciter, and adapted to select the material to be crushed conveyed by the feeder so as to fall down at least soil, and shingle and convey large rock to the crusher, and said conveyor discharging the at least selected soil, and shingle and material pieces crushed by the crusher, and wherein the vibrating direction of said first vibration exciter (29) is made near the horizontal plane more than the vibrating direction of said second vibration exciter (33), said second vibration exciter (33) vibrates in a magnitude more than that of said first vibration exciter (29) thereby to make large a selecting ability of said selective feeder and to make a conveying ability of said feeder substantially equal to that of said selective feeder.

2. A self-propelling crushing machine comprising:

a machine body (2) provided with a traveling body (1);

a hopper (4), a feeder (5), a selective feeder (6) and a crusher (3) which are mounted to the machine body;

a conveyer (7) disposed below the machine body;

a controlling device for independently controlling said feeder, said selective feeder, said crusher and said conveyer, said feeder being vibrated in an obliquely upper direction with respect to a horizontal plane by a first vibration exciter (29) and adapted to convey a material to be crushed from the hopper to the selective feeder, said selective feeder being disposed below said feeder, vibrated in an obliquely upper direction with respect to a horizontal plane by a second vibration exciter (33), and adapted to select the material to be crushed conveyed by the feeder so as to fall down at least soil, and shingle and convey large rock to the crusher, and said conveyor discharging the at least selected soil, and shingle and material pieces crushed by the crusher;

a selective feeder overload detection means (56) for detecting an overload state of said selective feeder (6);

means for making variable the conveying ability of said feeder (5); and a controlling means (54) for lowering the conveying ability of said feeder at a time when said selective feeder is discriminated to be in an overload state.

3. A self-propelling crushing machine according to claim 2, wherein said selective feeder overload detection means (57) is composed of means (73) for detecting a fact that a material to be crushed is stayed on the grizzly bar (32) in a level more than a predetermined height level.

4. A self-propelling crushing machine comprising:

a machine body (2) provided with a traveling body (1);

a hopper (4), a feeder (5), a selective feeder (6) and a crusher (3) which are mounted to the machine body;

a conveyer (7) disposed below the machine body;

a controlling device for independently controlling said feeder, said selective feeder, said crusher and said conveyer, said feeder being vibrated in an obliquely upper direction with respect to a horizontal plane by a first vibration exciter (29) and adapted to convey a material to be crushed from the hopper to the selective feeder, said selective feeder being disposed below said feeder, vibrated in an obliquely upper direction with respect to a horizontal plane by a second vibration exciter (33), and adapted to select the material to be crushed conveyed by the feeder so as to fall down at least soil, and shingle and convey large rock to the crusher, and said conveyor discharging the at least selected soil, and shingle and material pieces crushed by the crusher;

a crusher overload detection means (56) for detecting an overload state of the said crusher (3);

means for making variable the conveying ability of said feeder (5);

means for making variable the selecting ability and the conveying ability of said selective feeder (6); and a controlling means (54) for lowering the conveying ability of said feeder at a time when said crusher is discriminated to be in an overload state and maintaining the selecting ability and the conveying ability of said selective feeder to normal values.

* * * * *